US011608833B2

(12) United States Patent
Liu et al.

(10) Patent No.: US 11,608,833 B2
(45) Date of Patent: Mar. 21, 2023

(54) CENTRIFUGAL COMPRESSOR AND AIR CONDITIONING EQUIPMENT

(71) Applicant: Gree Electric Appliances, Inc. of Zhuhai, Guangdong (CN)

(72) Inventors: Hua Liu, Guangdong (CN); Zhiping Zhang, Guangdong (CN); Hongbo Li, Guangdong (CN); Ruixing Zhong, Guangdong (CN); Yuhui Chen, Guangdong (CN); Wenteng Ye, Guangdong (CN); Jingli Qi, Guangdong (CN); Sheng Liu, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/295,723

(22) PCT Filed: Oct. 24, 2019

(86) PCT No.: PCT/CN2019/113018
§ 371 (c)(1),
(2) Date: May 20, 2021

(87) PCT Pub. No.: WO2020/134433
PCT Pub. Date: Jul. 2, 2020

(65) Prior Publication Data

US 2022/0003238 A1 Jan. 6, 2022

(30) Foreign Application Priority Data

Dec. 25, 2018 (CN) ..... 201811593330.0

(51) Int. Cl.
*F04D 29/051* (2006.01)
*F04D 17/10* (2006.01)
(Continued)

(52) U.S. Cl.
CPC ..... *F04D 29/0513* (2013.01); *F04D 17/10* (2013.01); *F04D 29/053* (2013.01); *F04D 29/441* (2013.01)

(58) Field of Classification Search
CPC .. F04D 29/057; F04D 29/051; F04D 29/0513; F04D 17/10; F04D 17/122; F04D 17/12
See application file for complete search history.

(56) References Cited

U.S. PATENT DOCUMENTS 4,385,768 A 5/1983 Swearingen
4,986,733 A * 1/1991 Fleury ..... F04D 29/266 415/230
(Continued)

FOREIGN PATENT DOCUMENTS

CN 106438446 A 2/2017
CN 107939699 A 4/2018
(Continued)

*Primary Examiner* — Justin D Seabe
(74) *Attorney, Agent, or Firm* — The Webb Law Firm

(57) ABSTRACT

The present disclosure relates to a centrifugal compressor and air conditioning equipment. The centrifugal compressor includes: a main shaft; a diffuser, provided with a first thrust bearing at one end away from a diffusion surface; a supporting assembly, provided with a second thrust bearing at one end facing towards the diffuser; and a thrust disk, configured to rotate together with the main shaft, located between the diffuser and the supporting assembly along an axial direction and provided with a thrust portion, a clearance between one side of the thrust portion and the first thrust bearing and a clearance between the other side of the thrust portion and the second thrust bearing being limited through mutual abutting of the diffuser and the supporting assembly.

13 Claims, 3 Drawing Sheets

(51) Int. Cl.
*F04D 29/053* (2006.01)
*F04D 29/44* (2006.01)

(56) References Cited

U.S. PATENT DOCUMENTS

| | | | | |
|---|---|---|---|---|
| 6,729,858 | B2 * | 5/2004 | Choi | F04D 17/122 417/372 |
| 8,998,494 | B2 | 4/2015 | Steinmann et al. | |
| 9,157,447 | B2 | 10/2015 | Freeman et al. | |
| 10,760,583 | B2 | 9/2020 | Bonnefoi et al. | |
| 10,808,757 | B2 * | 10/2020 | Ryu | F16C 29/025 |
| 2002/0037215 | A1 | 3/2002 | Choi et al. | |
| 2003/0059315 | A1 | 3/2003 | Choi et al. | |
| 2011/0243762 | A1 * | 10/2011 | Daikoku | F04D 25/0606 384/105 |
| 2012/0051957 | A1 | 3/2012 | Beers et al. | |
| 2013/0170943 | A1 | 7/2013 | Jonsson et al. | |
| 2020/0056622 | A1 | 2/2020 | Tian et al. | |

FOREIGN PATENT DOCUMENTS

| | | | | |
|---|---|---|---|---|
| CN | 209340164 | U | 9/2019 | |
| DE | 102015007379 | A1 * | 1/2016 | F01D 25/168 |
| DE | 102015016607 | A1 | 8/2016 | |
| WO | 2013142461 | A1 | 9/2013 | |
| WO | 2016038661 | A1 | 3/2016 | |
| WO | 2018041949 | A1 | 3/2018 | |
| WO | 2018191351 | A1 | 10/2018 | |

* cited by examiner

CENTRIFUGAL COMPRESSOR AND AIR CONDITIONING EQUIPMENT

CROSS-REFERENCE TO RELATED APPLICATIONS

The present application is a National Stage of International Application No. PCT/CN2019/113018 filed on Oct. 24, 2019, which claims the priority of the Chinese patent application No. 201811593330.0, entitled "CENTRIFUGAL COMPRESSOR AND AIR CONDITIONING EQUIPMENT" and filed on Dec. 25, 2018, both of which are incorporated herein by reference in their entireties.

BACKGROUND OF THE DISCLOSURE

Field of the Disclosure

The present disclosure relates to the technical field of air compression equipment, and in particular, to a centrifugal compressor and air conditioning equipment.

Description of Related Art

A dynamic pressure gas bearing has the advantages of high precision, low friction loss, long life, low vibration, no pollution and no need of providing a lubricating medium, etc. Meanwhile, the dynamic pressure gas bearing is suitable for occasions with high rotating speed and high precision, and has a wide application prospect in centrifugal compressors, especially small centrifugal compressors. However, the clearance of the gas bearing is very small, only several microns or even tens of microns, and the machining precision of parts is required to be sub-micron. Therefore, it is very important to ensure a thrust surface clearance of the thrust bearing. If the clearance is controlled inaccurately, the performance of the thrust bearing will be reduced, and in severe cases, the bearing will fail.

SUMMARY OF THE DISCLOSURE

One aspect of embodiments of the present disclosure provides a centrifugal compressor, including:

a main shaft;

a diffuser, provided with a first thrust bearing at one end away from a diffusion surface;

a supporting assembly, provided with a second thrust bearing at one end facing towards the diffuser; and a thrust disk, configured to rotate together with the main shaft, located between the diffuser and the supporting assembly along an axial direction and provided with a thrust portion, a clearance between one side of the thrust portion and the first thrust bearing and a clearance between other side of the thrust portion and the second thrust bearing being limited through mutual abutting of the diffuser and the supporting assembly.

In some embodiments, a first groove is formed at one end, away from the diffusion surface, of a diffuser; a first thrust bearing is arranged at the bottom of the first groove along the axial direction; and a thrust portion is located in the first groove.

In some embodiments, the centrifugal compressor further includes a shell and a radial bearing, wherein the supporting assembly includes:

a fixing plate, provided with the second thrust bearing on one side facing towards the diffuser; and a bearing support, arranged one side, away from the diffuser, of the fixing plate, a first end of the bearing support being connected to the fixing plate, and a second end of the bearing support being connected to a shell and configured to supporting a main shaft through a radial bearing.

In some embodiments, a fixing plate and a bearing support form an integrated structure.

In some embodiments, a fixing plate is configured to limit a displacement of a radial bearing towards one side of a diffuser along an axial direction.

In some embodiments, a locating ring is arranged at one end, facing towards a bearing support, of a fixing plate; the bearing support is provided with a second annular groove; the locating ring is arranged into the second groove; and an inner wall of the locating ring engages with an outer wall of a partial length section of a radial bearing.

In some embodiments, the centrifugal compressor further includes a shell and a radial bearing, wherein the supporting assembly includes:

a bearing support, connected to the shell, a second thrust bearing being arranged on one side, facing towards a diffuser, of the bearing support, and the bearing support being configured to support a main shaft through the radial bearing.

In some embodiments, the centrifugal compressor further includes a shell and a radial bearing, wherein the supporting assembly includes a bearing support, a first end of the bearing support abutting against diffuser, a second end of the bearing support being connected to the shell and configured to support a main shaft through the radial bearing, and radial outline dimensions of the bearing support gradually increasing from the first end to the second end thereof.

In some embodiments, the centrifugal compressor further includes a radial bearing, wherein the supporting assembly includes a bearing support configured to support a main shaft through the radial bearing, the bearing support being provided with a vent hole configured to communicate a space where the radial bearing is located with a space where the first thrust bearing and the second thrust bearing are located.

In some embodiments, a first thrust bearing is directly fixed at the bottom of a first groove.

In some embodiments, the centrifugal compressor further includes an impeller and a locking part, wherein the main shaft is internally provided with a cavity and is provided with a shaft core at the center, an end of the shaft core extending out of an end of the main shaft; and the impeller sleeves an outer end of the shaft core and locks the impeller on the shaft core through the locking part, and the impeller is located on an outer side of the diffuser.

In some embodiments, the thrust disk further includes a connection portion, wherein the connection portion is connected to the thrust portion and sleeves the main shaft; a through hole is provided at the bottom of the first groove; and the connection portion is arranged into the through hole.

In some embodiments, the centrifugal compressor further includes a sealing structure and an impeller on an end of the main shaft, wherein the impeller is located on an outer side of the diffuser, and the sealing structure adopts at least one of the following structures:

a first axial comb-tooth sealing structure, arranged on a side wall of the through hole;

a radial comb-tooth sealing structure, arranged on an end part, facing towards the diffuser, of the impeller; and a second axial comb-tooth sealing structure, wherein the impeller is provided with an protruding portion arranged into the diffuser, and the second axial comb-tooth sealing structure is arranged on the protruding portion along the axial direction.

In some embodiments, the sealing structure simultaneously includes: a first axial comb-tooth sealing structure, and a radial comb-tooth sealing structure and a second axial comb-tooth sealing structure which are arranged at the same time, wherein the radial comb-tooth sealing structure is located between the first axial comb-tooth sealing structure and the second axial comb-tooth sealing structure along a radial direction.

In some embodiments, the centrifugal compressor further includes a radial bearing configured to support a main shaft. At least one of the first thrust bearing, the second thrust bearing and the radial bearing is an air-suspending bearing.

Another aspect of embodiments of the present disclosure provides air conditioning equipment, including the centrifugal compressor according to the above embodiments.

BRIEF DESCRIPTION OF THE DRAWINGS

The accompanying drawings are used to provide further understanding of the present disclosure and constitute a part of the present disclosure. The exemplary embodiments of the present disclosure and the description thereof serve to explain the present disclosure, but do not constitute an improper limitation to the present disclosure. In the accompanying drawings.

DETAILED DESCRIPTION

The present disclosure is described hereinafter in detail. In the following paragraphs, different aspects of embodiments are defined in detail. The aspects defined may be combined with one or more of any other aspects unless it is explicitly pointed that they cannot be combined. In particular, any features considered to be preferred or favorable may be combined with one or more of other features considered to be preferred or favorable combination.

The terms "first", "second" and the like appearing in the present disclosure are only used to facilitate description so as to distinguish different components with the same name, but not to represent a sequence or a primary and secondary relationship.

To clearly describe each azimuth in the following embodiments, an azimuth or position relationship indicated by terms "upper", "lower", "top", "bottom", "front", "rear", "inner", "outer" and the like is described only for facilitating the description of the present disclosure, but not for indicating or implying that the referred device must have a specific azimuth and perform construction and operation in the specific azimuth; therefore, it cannot be interpreted as a limitation to the protection scope of the present disclosure. Furthermore, as shown in FIG. 1, "axial direction", "circumferential direction" and "radial direction" mentioned hereafter are all defined on the basis of a main shaft 1.

Embodiments of the present disclosure provide a centrifugal compressor and air conditioning equipment, thus improving the assembling precision of a thrust bearing in the compressor.

To make those skilled in the art understand the improvement points of the present disclosure more clearly, the overall structure of the centrifugal compressor is described with reference to FIG. 1.

Figure 1:
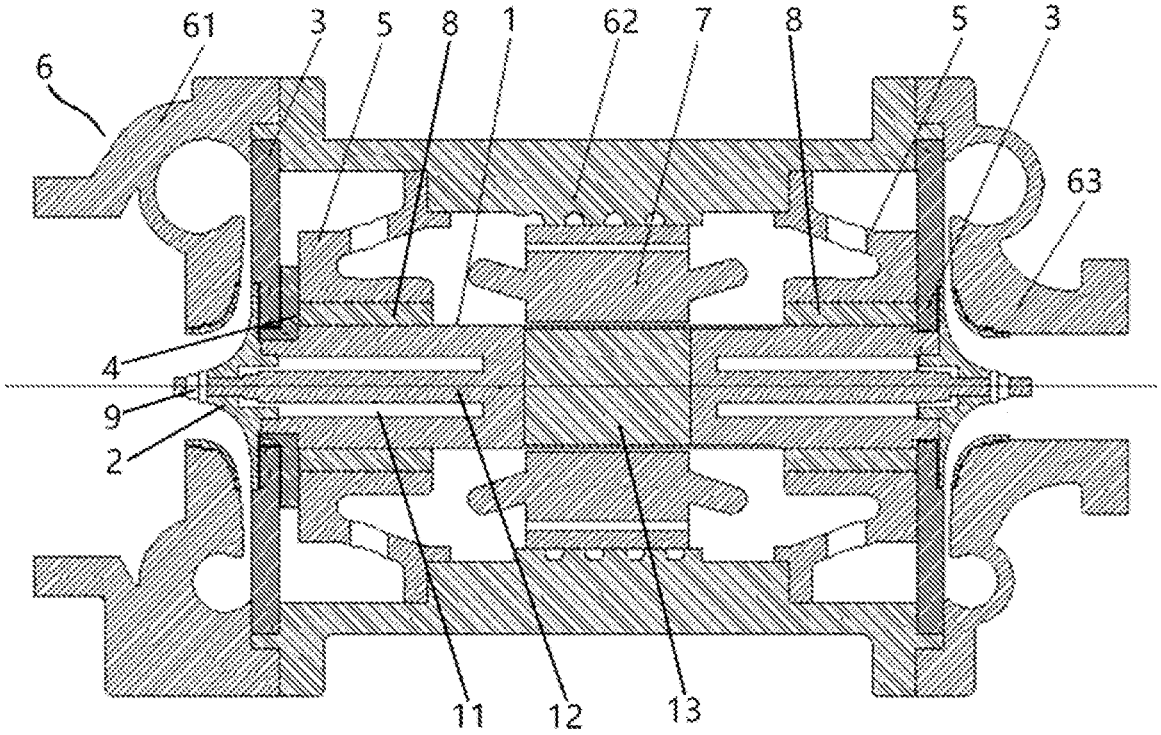
FIG. 1 is a structural schematic diagram of some embodiments of a centrifugal compressor according to the present disclosure.

As shown in FIG. 1, by taking a two-stage centrifugal compressor as an example, the compressor includes a first volute 61, a second volute 63 and a middle shell 62, wherein the first volute 61 and the second volute 63 are respectively arranged at two ends of the middle shell 62 is along the axial direction to jointly form a compressor shell 6. A main shaft 1 is arranged at the center position of the compressor shell 6, an impeller 2 is arranged at each of two ends of the main shaft 1, and a diffuser 3 is arranged at an inner end of the impeller 2. When the impellers 2 rotate at a high speed, gas rotates along with the impellers 2, the gas is thrown into the diffuser 3 under a centrifugal force, velocity energy of an outlet medium of the impellers 2 is converted into pressure energy, and the gas is discharged from the volutes after pressure is increased.

To support the main shaft 1, radial bearings 8 are arranged at two ends of the main shaft 1, the radial bearings 8 perform supporting through a bearing support 52, and the bearing support 52 is connected to the middle shell 62. A stator assembly 7 is arranged between the main shaft 1 and the middle shell 62. Since each of the impellers 2 will generate an axial force, a thrust bearing is arranged at one end of the main shaft 1 to balance the axial force generated by the impellers 2.

The working principle of the compressor is: in the working process of the compressor, the main shaft 1 rotates at a high speed, gas enters the diffuser 3 through the impeller 2 on the left side, the gas enters the first volute 61 after being subjected to primary compression, an exhaust channel in the first volute 61 guides the compressed gas into the impeller 2 on the right side, the gas enters the diffuser 3 on the right side after being centrifuged by the impeller 2 on the right side, the gas enters the second volute 63 after being subjected to secondary compression, and the gas is discharged out of the compressor through an exhaust channel in the second volute 63.

Then, a bearing supporting assembly in the centrifugal compressor is described in detail. In some embodiments, as shown in FIG. 2, the centrifugal compressor includes: a main shaft 1, an impeller 2, a diffuser 3, a thrust disk 4 and a supporting assembly 5.

Wherein the main shaft 1 is provided with magnetic steel 13 along a middle position of the axial direction; the diffuser 3 is fixed on the shell 6; a first thrust bearing 10 is arranged at one end, away from a diffusion surface, of the diffuser 3; and the diffusion surface is an end face closed to the impeller 2. The supporting assembly 5 is arranged at one end, away from the diffusion surface, of the diffuser 3. One end of the supporting assembly 5 is fixed with the shell 6 of the compressor, and the other end of the supporting assembly 5 abuts against an end face of the diffuser 3. A second thrust bearing 10' is arranged on one side, facing towards the diffuser 3, of the supporting assembly 5. The thrust disk 4 is fixed with the main shaft 1 and is configured to rotate together with the main shaft 1. The thrust disk 4 is provided with a thrust portion 41, for example, a disk-shaped structure. A clearance between one side of the thrust portion 41 and the first thrust bearing 10 and a clearance between the other side of the thrust portion 41 and the second thrust bearing 10' are limited through mutual abutting of the diffuser 3 and the supporting assembly 5. Specifically, left and right surfaces of the thrust portion 41 and the thrust bearings on two sides form working surfaces, which may withstand bidirectional axial forces, thus ensuring operational stability and reliability of the compressor under full working conditions and during reverse rotation.

For example, the first thrust bearing 10 and the second thrust bearing 10' are static pressure or dynamic pressure gas thrust bearings, or magnetic levitation bearings.

Figure 2:
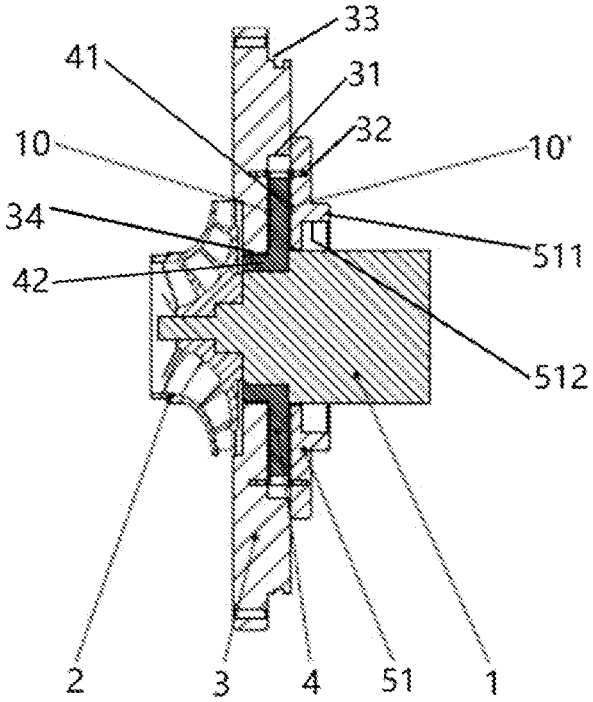
FIG. 2 is a schematic diagram of a mounting structure of a diffuser, a thrust disk and a fixing plate in a centrifugal compressor according to the present disclosure.

By taking FIG. 2 as an example, since there is a clearance between the thrust bearing and the thrust disk 4, gas will form a gas film with a pressure in the clearance for thrusting and lubricating. Since the thrust bearing itself is in a cavity of the compressor and the cavity is full of the gas, the gas may be brought into the clearance to form a dynamic pressure gas thrust bearing in the rotation process of the rotor.

In the centrifugal compressor of the embodiment, the thrust disk cooperates with the thrust bearings on the two sides, which may bear axial forces in left and right directions, thus ensuring the operation stability of the compressor under full working conditions and during reverse rotation. The operation working conditions of the compressor refer to an evaporation temperature and a condensation temperature of a system where the compressor is located. The full working conditions refer to that the compressor works within a certain evaporation temperature range and a condensation temperature range. When the compressor is shut down, since an exhaust pressure is higher than a suction pressure, the compressor will rotate reversely after shutdown.

Furthermore, the diffuser 3 and the supporting assembly 5 need to be fixed on the shell 6 of the compressor, so the own position is fixed. The supporting assembly 5 and the diffuser 3 abut against each other for combined limitation, thus limiting the position of the thrust disk 4 and the clearances of the thrust bearings on the two sides. Therefore, the working clearance of the thrust bearings may be accurately ensured, the assembling difficulty is reduced, the assembling efficiency and the assembling precision are improved, and the working performance of the compressor is improved, thereby improving the operation stability of the compressor.

As shown in FIG. 2, a first groove 31 is formed at one end, away from a diffusion surface, of a diffuser 3, a first thrust bearing 10 is arranged at the bottom of the first groove 31 along the axial direction, a thrust portion 41 is located in the first groove 31, and there are a clearance between the one side of the thrust portion 41 and the first thrust bearing 10 and a clearance between the other side of the thrust portion 41 and the second thrust bearing 10'.

Since the diffuser 3 and the supporting assembly 5 abut against each other, such that the clearances of the thrust bearings on two sides may be accurately ensured through an axial depth of the first groove 31, the assembling precision may be improved, the assembling difficulty is reduced, the assembling efficiency is improved, the performance of the thrust bearing can be ensured, and reduction, even failure of the performance of the thrust bearing caused by inaccurate clearance control is avoided, thus improving the operation stability of the compressor.

As shown in FIG. 2, a depth of the first groove 31 includes: a thickness of the thrust portion 41, a total thickness of the thrust bearings on two sides and the clearances of the thrust bearings on two sides; therefore, to ensure the clearances of the thrust bearings on two sides, the clearances may be controlled by the depth of the first groove 31, the thickness of the thrust portion 41 and the thicknesses of the thrust bearings on two sides. The specific method is: a design depth and a tolerance range of the first groove 31 are derived according to a clearance range which the thrust bearings need to reach, a thickness tolerance range of the thrust portion 41 and a thickness tolerance range of the thrust bearings. Therefore, clearances between the thrust bearings can be ensured by improving the machining precision of the depth of the first groove 31, the assembling precision may be improved and the assembling difficulty is reduced, thus improving the assembling efficiency.

Figure 3:
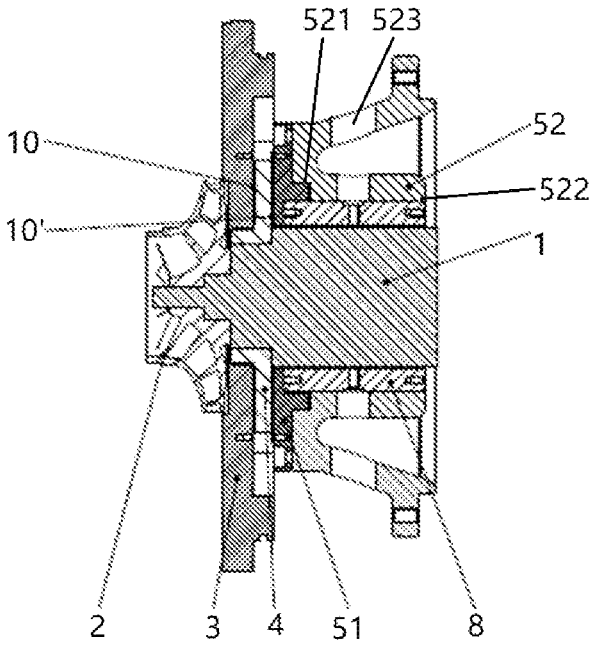
FIG. 3 is a schematic diagram of a mounting structure of a diffuser, a thrust disk, a fixing plate and a bearing support in a centrifugal compressor according to the present disclosure.

In some embodiments, as shown in FIG. 2 and FIG. 3, the centrifugal compressor further includes a shell 6 and a radial bearing 8 configured to bear a radial force of a rotor, wherein the radial force of the rotor mainly comes from the gravity of the rotor. For example, the radial bearing 8 is a static pressure or dynamic pressure gas radial bearing, or a magnetic levitation bearing.

The supporting assembly 5 includes a fixing plate 51 and a bearing support 52, wherein the fixing plate 51 abuts against the diffuser 3, and the second thrust bearing 10' is arranged on one side, facing towards the diffuser 3, of the fixing plate 51; and the bearing support 52 is arranged on one side, away from the diffuser 3, of the fixing plate 51, a first end of the bearing support 52 is connected to the fixing plate 51, and a second end of the bearing support 52 is connected to the shell 6, the bearing support 52 is configured to support a main shaft 1 through the radial bearing 8.

In this embodiment, the supporting assembly 5 adopts a split structure, the second thrust bearing 10' is mounted through the fixing plate 51, and the radial bearings 8 are mounted on the bearing support 52, such that the mounting position precision, including the coaxiality of the two radial bearings 8 and the perpendicularity of the thrust bearings, of the radial bearings 8 at two ends of the main shaft 1 and the thrust bearings may be improved, and the working stability of the rotor system may be improved.

Figure 5:
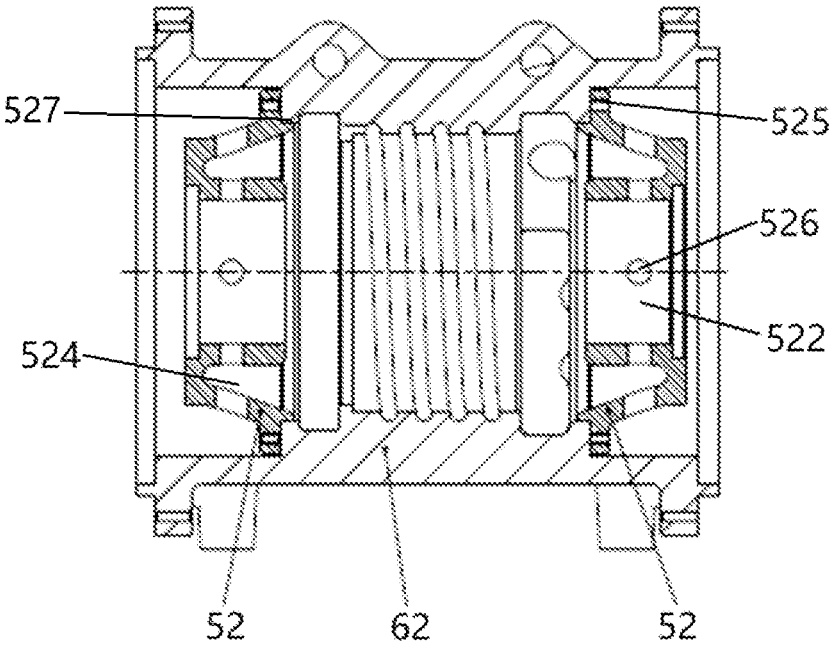
FIG. 5 is a schematic diagram of a mounting structure of a bearing support and a shell in a centrifugal compressor according to the present disclosure.

As shown in FIG. 5, a flange disk 525 is arranged at a second end of the bearing support 52, a spigot 527 is formed at an outer end of the flange disk 525, the bearing support 52 is mounted in a middle shell 62 through the flange disk 525 and is fixed through a fastener 32, and the bearing support 52 is radially located by the spigot 527.

During machining, the two bearing supports 52 are assembled in the middle shell 62 through first location of the spigot 527 firstly, then the flange disk 525 and the middle shell 62 are fixed through the fasteners 32, and a pin is punched for fixation. Then, the middle shell 62 and the two bearing supports 52, serving as an whole assembly, are located on machining equipment, and end faces, contacting with the fixing plates 51, of the two bearing supports 52 are machined to ensure the perpendicularity of the thrust bearings and the radial bearings 8, and mounting holes 522 of the two bearing supports 52 are machined sequentially from one side to ensure the coaxiality of the two radial bearings 8.

After machining, the bearing supports 52 are disassembled, each the radial bearing 8 is mounted into the mounting holes 522 of the bearing supports 52 through a hot mounting manner, and then the fixing plate 51 are mounted at a first end of the bearing support 52. The bearing supports 52 are fixedly mounted on the shell 6 through the position of the pin determined during machining.

Since each key locating part is machined in one clamping process, the coaxiality of the two radial bearings 8 and the perpendicularity of the thrust bearings may be ensured, thus improving the working stability of the rotor system.

As shown in FIG. 3, the fixing plate 51 is further configured to limit a displacement of each of the radial bearings 8 towards one side of the diffuser 3 along the axial direction; therefore, the fixing plate 51 is capable of mounting the second thrust bearing 10' and also capable of axially limiting the radial bearings 8, such that the structure of the bearing supporting assembly may be more compact, and it is beneficial to ensure a parallelism of a mounting surface of the second thrust bearing 10' and an axial limiting surface of each of the radial bearings 8 through a machining parallelism of two sides of the fixing plate 51, thus improving the mounting precision of the thrust bearing and the radial bearings 8.

In some embodiments, a locating ring 511 is arranged at one end, facing towards the bearing support 52, of the fixing plate 51, the bearing support 52 is provided with an annular second groove 521, the locating ring 511 is arranged into the second groove 521 to radially locate the fixing plate 51, and there is a clearance between the fixing plate 51 and the main shaft 1. Furthermore, an inner wall of the locating ring 511 engages with an outer wall of a partial length section of the radial bearing 8 for supporting the partial length section of the radial bearing 8 and playing an axial thrust role in the radial bearing 8.

In some embodiments, as shown in FIG. 2, the first thrust bearing 10 is fixed on the diffuser 3 through a fastener 32, the second thrust bearing 10' is fixed on the fixing plate 51 through the fastener 32, the fixing plate 51 and the diffuser 3 abut against each other, and a spigot 33 is formed at the periphery of the diffuser 3, thereby facilitating location and mounting of a shell 6.

Figure 4:
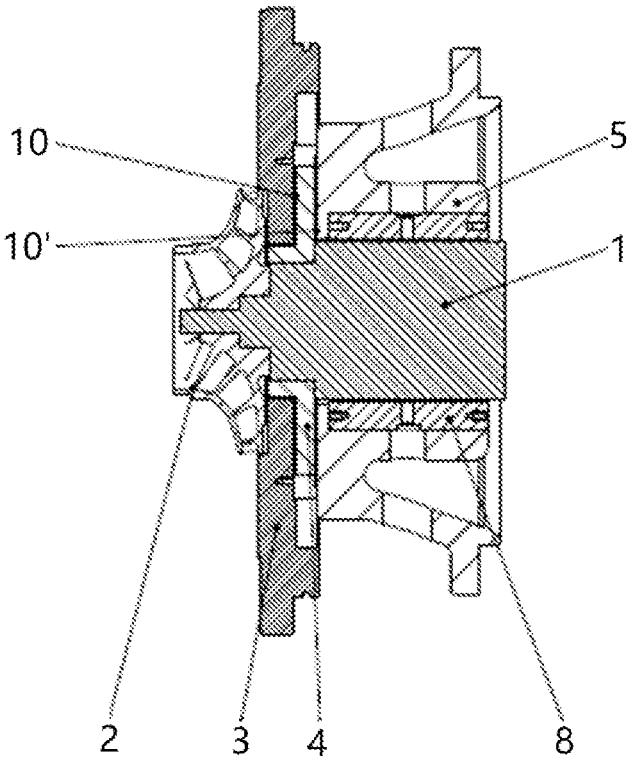
FIG. 4 is a schematic diagram of an integrated structure of a fixing plate and a bearing support in a centrifugal compressor according to the present disclosure.

In some embodiments, as shown in FIG. 4, a fixing plate 51 and a bearing support 52 form an integrated structure. The supporting assembly 5 adopts an integrated structure, such that the structure may be simplified, the assembly difficulty may be reduced, and it is easy to ensure the perpendicularity of the radial bearing 8 and the thrust bearing through the machining precision of the supporting assembly 5.

In some embodiments, referring to FIG. 4, the centrifugal compressor further includes a shell 6 and a radial bearing 8. The supporting assembly 5 includes a bearing support 52, wherein a first end of the bearing support 52 abuts against a diffuser 3 and a second end of the bearing support 52 is connected to the shell 6; the second thrust bearing 10' is arranged on one side, facing towards the diffuser 3, of the bearing support 52; and the bearing support 52 is further configured to support a main shaft 1 through the radial bearing 8. A thrust platform is reserved on the bearing support 52 when a mounting hole 522 is machined so as to axially limit the radial bearing 8.

Compared with the embodiment as shown in FIG. 4, a fixing plate 51 is omitted, such that an axial size of the bearing supporting assembly may be further reduced, the structure can be simplified, the assembling difficulty is reduced, and it is easy to ensure the perpendicularity of the radial bearing 8 and the thrust bearing through the machining precision of the supporting assembly 5.

As shown in FIG. 3 and FIG. 4, the centrifugal compressor further includes a shell 6 and a radial bearing 8. The supporting assembly 5 includes a bearing support 52, wherein a first end of the bearing support 52 abuts against a diffuser 3, and a second end of the bearing support 52 is connected to the shell 6 for supporting a main shaft 1 through the radial bearing 8. Since an outer diameter of the thrust bearing is less than an inner diameter of the shell 6, accordingly, outline dimensions of the bearing support 52 in a longitudinal section gradually increase from the first end to the second end, that is, radial outline dimensions of the bearing support 52 gradually increase from the first end to the second end thereof. To reduce the weight, as shown in FIG. 5, a weight-reducing groove 524 is formed in one side, away from the thrust bearing, of the bearing support 52, for example, the weight-reducing groove 524 is arranged annularly, an inner wall of the weight-reducing groove 524 is parallel to a side wall of the mounting hole 522, and an outer wall of the weight-reducing groove 524 is consistent with an overall shape of the bearing support 52.

The V-shaped bearing support 52 adopts a structure with gradually varied cross sectional area, such that the overall structural strength of the bearing support 52 may be improved, stress in all places is distributed uniformly and the bearing capacity may be optimized; moreover, an outer side wall is an inclined surface which is easily realized by casting, and has a draft angle when being cast by a mold.

As shown in FIG. 5, the bearing support 52 is provided with a vent hole 526 configured to communicate a space where the radial bearing 8 is located with a space where the first thrust bearing 10 and the second thrust bearing 10' are located, such that the working environment of the radial bearing 8 is consistent with those of the first thrust bearing 10 and the second thrust bearing 10', for example, the working back pressure of the radial bearing 8 is consistent with those of the first thrust bearing 10 and the second thrust bearing 10'. A refrigerant for cooling a motor enters and exits a motor cavity, when the compressor operates normally, pressure and temperature of the overall motor cavity are stable, the working environment of the thrust bearing and the radial bearing is as same as that of the motor cavity, that is, gas circulation is ensured, the back pressure is relatively stable, and fluctuation of a bearing gas film caused by too large fluctuation is reduced, thus improving the performance of the bearing.

As shown in FIG. 3, the bearing support 52 is provided with an operating hole 523 along a radial direction, such that a vibration sensor or a temperature sensor is mounted on an outer wall of the radial bearing 8 through the operating hole 523 to monitor the working state of the radial bearing 8. A hole section of the operating hole 523 along a radial outer side serves as a bypass hole so as to ensure that the pressure and temperature of the thrust bearing and the radial bearing 8 are as same as those of the motor cavity; and a hole section of the operating hole 523 along a radial inner side serves to dissipate heat for the radial bearing 8.

In some embodiments, as shown in FIG. 3, the first thrust bearing 10 is directly fixed at the bottom of the first groove 31 of the diffuser 3. For example, the first thrust bearing 10 adopts a dynamic pressure thrust bearing which is a flaky structure. The dynamic pressure thrust bearing is directly fixed at the bottom of the first groove 31. According to the structure, the diffuser 3 and the fixing plate of the thrust bearing are integrated into a part, the bottom of the first groove 31 may serve as the fixing plate of the first thrust bearing 10 without additionally setting the fixing plate of the thrust bearing, such that an axial size of the bearing supporting assembly may be further reduced and the structure is more compact.

In some embodiments, as shown in FIG. 1, the centrifugal compressor further includes an impeller 2 and a locking part 9, wherein the main shaft 1 is internally provided with a cavity 11 and is provided with a shaft core 12 at the center, an end of the shaft core 12 extending out of an end of the main shaft 1; and the impeller 2 sleeves an outer end of the shaft core 12 and locks the impeller 2 on the shaft core 12 through the locking part 9, and the impeller 2 is located on an outer side of the diffuser 3.

According to this embodiment, the impeller 2 may be detachably arranged relative to the main shaft 1, such that the assembling and disassembling difficulty of the impeller may be reduced, the assembling process of the impeller and the required equipment are simplified, and the assembling efficiency and the operability of the disassembling and inspection work and maintenance are improved. Furthermore, the mounting mode can prevent the main shaft 1 or the impeller 2 from being deformed, may ensure the mounting strength of the impeller 2 and may avoid stress concentration, thus improving the compression capacity of the compressor. In addition, the cavity 11 is formed in the main shaft 1, such that the weight of the main shaft 1 may be reduced, thus increasing the critical rotating speed of the main shaft 1 and further improving the ultimate working capacity of the compressor.

Still referring to FIG. 1, the shaft core 12 is directly formed when the cavity 11 is machined, such that the shaft core 12 and the rest part of the main shaft 1 are machined into a whole body, it is unnecessary to additionally mount the shaft core 12 in the cavity of the main shaft 1, the assembling difficulty may be further reduced, the connection strength of the shaft core 12 and the main shaft 1 is improved, the position precision of the shaft core 12 may be ensured, the bounce problem of the front end of the rotor is effectively solved, and the length of a cantilever end is reduced, thus improving the working stability and reliability of the compressor. For example, the cavity 11 is a ring groove, or a plurality of holes which are symmetrical relative to the center of an axis.

As shown in FIG. 3, the thrust disk 4 further includes a connection portion 42, wherein the connection portion 42 is connected to the thrust portion 41 and sleeves the main shaft 1; a through hole 34 is formed at the bottom of the first groove 31; and the connection portion 42 is arranged into the through hole 34. The connection portion 42 is in interference fit with the main shaft 1, such that the thrust disk 4 may rotate together with the main shaft 1. The diffuser 3 and the fixing plate 51 are fixedly arranged, and there is a clearance between the diffuser 3 and the main shaft 1. For example, the thrust disk 4 has a cylindrical stepped structure.

Figure 6:
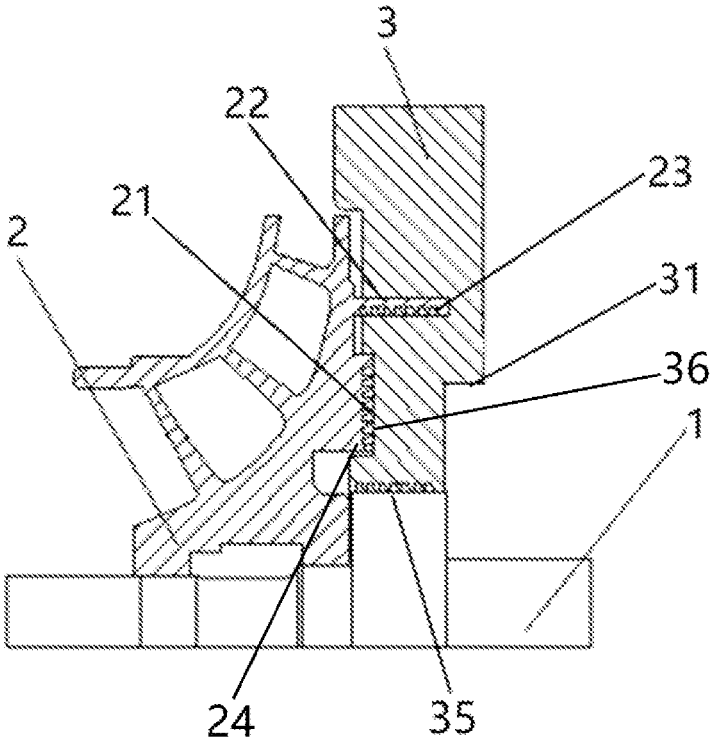
FIG. 6 is a structural schematic diagram of some embodiments of a sealing structure in a centrifugal compressor according to the present disclosure.

As shown in FIG. 6, the centrifugal compressor further includes a sealing structure and an impeller 2 arranged on an end of the main shaft 1, wherein the impeller 2 is located on an outer side of the diffuser 3. In some embodiments, a first axial comb-tooth sealing structure 35 is arranged on a side wall of the through hole 34 and forms a shaft seal with the thrust disk 4, thus reducing refrigerants from entering a motor cavity through the clearance between the diffuser 3 and the thrust disk 4 along with the exhaust of the impeller. In some embodiments, a radial comb-tooth sealing structure 21 is arranged on an end, facing towards the diffuser 3, of the impeller 2, thus reducing refrigerants from flowing towards the periphery along with the clearance between the impeller 2 and the diffuser 3. In some embodiments, the impeller 2 is provided with an protruding portion 22 arranged into the diffuser 3, for example, the protruding portion 22 is of an elongated strip structure extending along the axial direction, the protruding portion 22 is provided with a second axial comb-tooth sealing structure 23 on a radial inner side along a length direction of the protruding portion 22, thus reducing refrigerants from flowing towards the periphery along the clearance between the impeller 2 and the diffuser 3.

In some embodiments, the comb-tooth sealing structure includes a plurality of teeth arranged at intervals, wherein the teeth are trapezoidal; and one side wall of each tooth is a vertical surface, and the other side wall of each tooth is an inclined surface and inclines from a high-pressure side to a low-pressure side.

The embodiment can reduce the leakage amount of the refrigerants between the impeller 2 and the diffuser 3 and between the diffuser 3 and the thrust disk 4, can ensure the clearance required for operation of the main shaft 1 and the impeller 2, and also can prevent leakage of the refrigerants caused by too large clearance, thereby effectively solving the sealing problem of the compressor and improving the energy efficiency of the compressor.

Moreover, the structure integrates the diffuser 3, the fixing plate of the thrust bearing and a shaft sealing part into a part, such that the mounting structure may be simplified, the structure is more compact and the assembling efficiency is improved. As shown in FIG. 2, a spigot 33 is formed at the periphery of the diffuser 3 to facilitate location and mounting of the shell 6 and realize accurate location with the pin. Therefore, the coaxiality of the shaft sealing part on the diffuser 3 and the perpendicularity of a thrust bearing fixing surface are ensured on one part, and the machining difficulty and the assembling accumulated error are reduced. The shaft seal with high requirement on coaxiality and the thrust bearing with high requirement on perpendicularity are located jointly by the locating spigot 33 and the pin, the assembling standard is unified, the assembling difficulty is reduced and the assembling precision is improved, such that the perpendicularity of the thrust bearing fixing surface can be improved to ensure the working performance of the thrust bearing, and the coaxiality of the first axial comb-tooth sealing structure 35 can be improved to prevent the sealing property from being affected by the wear of the comb teeth.

In terms of material section, a material of the diffuser 3 has lower hardness than the thrust disk 4. Generally, the diffuser 3 adopts aluminum, and the thrust disk adopts 45 steel or 40 Cr, etc. In this way, if the first axial comb-tooth sealing structure 35 on the diffuser 3 and the main shaft 1 are worn, the comb teeth are worn firstly to prevent the main shaft 1 from being worn.

Still referring to FIG. 6, the sealing structure simultaneously includes a first axial comb-tooth sealing structure 35, a radial comb-tooth sealing structure 21 and a second axial comb-tooth sealing structure 23, wherein the radial comb-tooth sealing structure 21 is located between the first axial comb-tooth sealing structure 35 and the second axial comb-tooth sealing structure 23 along a radial direction. This arrangement can make gas flow form a circuitous flow path so as to optimize the gas flow deceleration and depressurization effect and improve the sealing property.

Specifically, a boss 24 is arranged at one end, facing towards the diffuser 3, of the impeller 2, the boss 24 stretches into a third groove 36 of the diffuser 3, and the radial comb-tooth sealing structure 21 is arranged on an end part of the boss 24, such that the gas flow path is further lengthened while radial sealing is realized, the gas flow deceleration and depressurization effect is optimized, and the sealing property is improved.

In addition, the present disclosure further provides air conditioning equipment, including the centrifugal compressor according to the above embodiments. The centrifugal compressor provided by the present disclosure may bear axial forces in two directions and ensure the operation stability of the compressor under full working conditions and during reverse rotation, and is capable of accurately ensuring the assembling clearance between the thrust bearings and ensuring the performance of the thrust bearings, thereby improving the operational stability of the compressor. The two factors can improve the working stability and reliability of the air conditioning equipment.

The centrifugal compressor and the air conditioning equipment according to the present disclosure are introduced above in detail. The principle and embodiments of the present disclosure are elaborated by specific embodiments, and the description of the above embodiments is only intended to help understand the method of the present disclosure and the core concept thereof. It should be noted that those skilled in the art may also make several improvements and modifications without departing from the principles of the present disclosure which should fall within the protection scope of the claims of the present disclosure.

The invention claimed is:

1. A centrifugal compressor, comprising:

a shell;

a radial bearing;

a main shaft;

a diffuser, provided with a first thrust bearing at one end away from a diffusion surface;

a supporting assembly, provided with a second thrust bearing at one end facing towards the diffuser; and a thrust disk, configured to rotate together with the main shaft, located between the diffuser and the supporting assembly along an axial direction and provided with a thrust portion, and a clearance between one side of the thrust portion and the first thrust bearing and a clearance between the other side of the thrust portion and the second thrust bearing are limited through mutual abutting of the diffuser and the supporting assembly;

wherein the supporting assembly comprises:

a fixing plate, provided with the second thrust bearing on one side facing towards the diffuser, a locating ring is arranged at one end, facing towards the bearing support, of the fixing plate; and a bearing support, arranged on one side, away from the diffuser, of the fixing plate, a first end of the bearing support being connected to the fixing plate, and a second end of the bearing support being connected to the shell and configured to support the main shaft through the radial bearing; the bearing support is provided with an annular second groove, the locating ring is arranged into the second groove, and an inner wall of the locating ring engages with an outer wall of a partial length section of the radial bearing, wherein a first groove is formed at one end, away from the diffusion surface, of the diffuser, the first thrust bearing is arranged at the bottom of the first groove along the axial direction, and the thrust portion is located in the first groove, and wherein the clearance of the thrust bearings on two sides of the thrust portion is controlled by the thickness of the first groove.

2. The centrifugal compressor according to claim 1, wherein the fixing plate and the bearing support form an integrated structure.

3. The centrifugal compressor according to claim 1, wherein the fixing plate is configured to limit a displacement of the radial bearing towards one side of the diffuser along the axial direction.

4. The centrifugal compressor according to claim 1, wherein the first end of the bearing support abuts against the diffuser.

5. The centrifugal compressor according to claim 1, the bearing support being provided with a vent hole configured to communicate a space where the radial bearing is located with a space where the first thrust bearing and the second thrust bearing are located, such that a working environment of the radial bearing is consistent with those of the first thrust bearing and the second thrust bearing, such that a working environment of the radial bearing is consistent with those of the first thrust bearing and the second thrust bearing.

6. The centrifugal compressor according to claim 1, further comprising an impeller and a locking part, wherein the main shaft is internally provided with a cavity and is provided with a shaft core at the center, an end of the shaft core extending out of an end of the main shaft; and the impeller sleeves an outer end of the shaft core and locks the impeller on the shaft core through the locking part, and the impeller is located on an outer side of the diffuser.

7. The centrifugal compressor according to claim 1, wherein the thrust disk further comprises a connection portion, the connection portion being connected to the thrust portion and sleeving the main shaft; and a through hole is provided at the bottom of the first groove, and the connection portion is arranged into the through hole.

8. The centrifugal compressor according to claim 7, further comprising a sealing structure and an impeller arranged on an end of the main shaft, wherein the impeller is located on an outer side of the diffuser, and the sealing structure adopts at least one of the following structures:

a first axial comb-tooth sealing structure, arranged on a side wall of the through hole;

a radial comb-tooth sealing structure, arranged on an end, facing towards the diffuser, of the impeller; and a second axial comb-tooth sealing structure, wherein the impeller is provided with a protruding portion arranged into the diffuser, and the second axial comb-tooth sealing structure is arranged on the protruding portion along the axial direction.

9. The centrifugal compressor according to claim 8, wherein the sealing structure comprises: the first axial comb-tooth sealing structure, the radial comb-tooth sealing structure and the second axial comb-tooth sealing structure, and the radial comb-tooth sealing structure being located between the first axial comb-tooth sealing structure and the second axial comb-tooth sealing structure along a radial direction.

10. The centrifugal compressor according to claim 1, wherein at least one of the first thrust bearing, the second thrust bearing, or the radial bearing is an air-suspending bearing.

11. Air conditioning equipment, comprising the centrifugal compressor according to claim 1.

12. The centrifugal compressor according to claim 1, wherein the first end of the bearing support abuts against the diffuser, and radial outline dimensions of the bearing support gradually increase from the first end to the second end thereof.

13. The centrifugal compressor according to claim 2, wherein the fixing plate is configured to limit a displacement of the radial bearing towards one side of the diffuser along the axial direction.

* * * * *